US005423296A

United States Patent [19]

Barr

[11] Patent Number: 5,423,296

[45] Date of Patent: Jun. 13, 1995

[54] LUBRICATION SYSTEM FOR INTERNAL COMBUSTION ENGINE

[75] Inventor: William F. Barr, Allen Park, Mich.

[73] Assignee: Ford Motor Company, Dearborn, Mich.

[21] Appl. No.: 173,004

[22] Filed: Dec. 27, 1993

[51] Int. Cl.[6] ..... F01M 11/02

[52] U.S. Cl. ..... 123/196 S; 138/26

[58] Field of Search ..... 123/196 R, 196 S; 138/26, 45, 46

[56] References Cited

U.S. PATENT DOCUMENTS 1,911,905 5/1933 Knowlton et al. ..... 138/46
2,615,442 10/1952 Berry .
2,893,514 7/1959 Badertscher .
3,485,324 12/1969 Novak .
3,557,767 1/1971 Green .
4,270,562 6/1981 Oberth et al. .
4,473,043 9/1984 Furukawa et al. ..... 123/196 AB
4,966,105 10/1990 Mori ..... 123/196 R

*Primary Examiner*—Henry C. Yuen
*Assistant Examiner*—Erick R. Solis
*Attorney, Agent, or Firm*—Jerome R. Drouillard; Roger L. May

[57] ABSTRACT

A lubrication system for an internal combustion system includes an oil pump having an inlet passage and a discharge port, a main oil supply gallery extending between the oil pump discharge port and at least one oil receiving location within the engine, and a damper situated within an oil supply gallery for limiting the propagation of pressure pulses within the gallery.

7 Claims, 2 Drawing Sheets

LUBRICATION SYSTEM FOR INTERNAL COMBUSTION ENGINE

BACKGROUND OF THE INVENTION

The present invention relates to a lubrication system for an internal combustion engine having a clamper for attenuating pressure pulses arising within the oil distribution system.

DESCRIPTION OF THE PRIOR ART

Automotive internal combustion engines typically use a recirculating lubrication system with oil as picked up from an oil pan by a mechanically driven oil pump operated by the crankshaft or camshaft of the engine. Oil is circulated from the pump to various points within the engine through passages called "galleries." These galleries may be either cored or drilled through the engine block cylinder head and other components of the engine and are typically cylindrical passageways. Unfortunately, because manufacturing considerations usually dictate that galleries be generally straight, with minimum interior restrictions, so as to cause the smallest possible drop in pressure as the oil circulates around the engine, pressure perturbations arising within the galleries have few restrictions and such perturbations may grow in magnitude and cause unwanted noise.

An example of a prior art engine gallery is shown in FIG. 3. Oil feed port 102 leads from the oil pump within cylinder block 100. The oil flowing through port 102 discharges into gallery 104, which has an end sealed by flat plug 106. Because gallery 104 is relatively straight and has smooth interior walls, pressure pulsations are free to move along the length of gallery 104 with relatively little inhibition. As a result, it has been observed in at least one production engine that a gallery construction of the type shown in FIG. 3, will cause a very objectionable noise. This noise is not unlike a mechanical noise due to excessive clearance between the connecting rod bearings and the crankshaft or between the main bearing inserts and the crankshaft. As a result, unnecessary work may be performed on an engine to determine the cause of the noise, with such work being almost always unsuccessful if the cause of the noise is not improperly fitted bearings, but rather acoustic waves set up within an oil gallery. Without wishing be bound by the theory, it is believed that acoustic noise may arise either from the hammering effect of the oil within he gallery or as a result of increased power consumption of the engine oil pump caused by reflected pressure waves impinging on discharge port 102, which are believed to increase the torque required to turn the oil pump and result in high level noise.

A lubrication system according to the present invention is advantageous because the damper will prevent the formation of acoustic waves or other pressure perturbations within an engine oil gallery so as to avoid problems with excessive noise associated with the engine oiling system in general, and the oil pump in particular.

SUMMARY OF THE INVENTION

According to the present invention, a lubrication system for an internal combustion engine includes an oil pump having an inlet passage and a discharge port, a main oil supply gallery extending between the oil pump discharge port and at least one oil receiving location within the engine, and a damper situated within the oil supply gallery for limiting the propagation of pressure pulses within the gallery. In general, the gallery is configured as a cylindrical bore, with the damper comprising a generally cylindrical body having one end projecting axially into the bore. The outer diameter of the cylindrical body is preferably just slightly less than the diameter of the cylindrical bore, with that end of the cylindrical body projecting into the bore comprising a generally conical surface having a central axis which is coincident with the central axis of the cylindrical body. The central axis of the cone is also coincident with the central axis of the bore. The conical surface at the end of the damper preferably projects into the bore or gallery to a location which is proximate the location at which oil is discharged into the gallery from the oil pump discharge port.

DETAILED DESCRIPTION OF THE PREFERRED EMBODIMENTS

Figure 1:
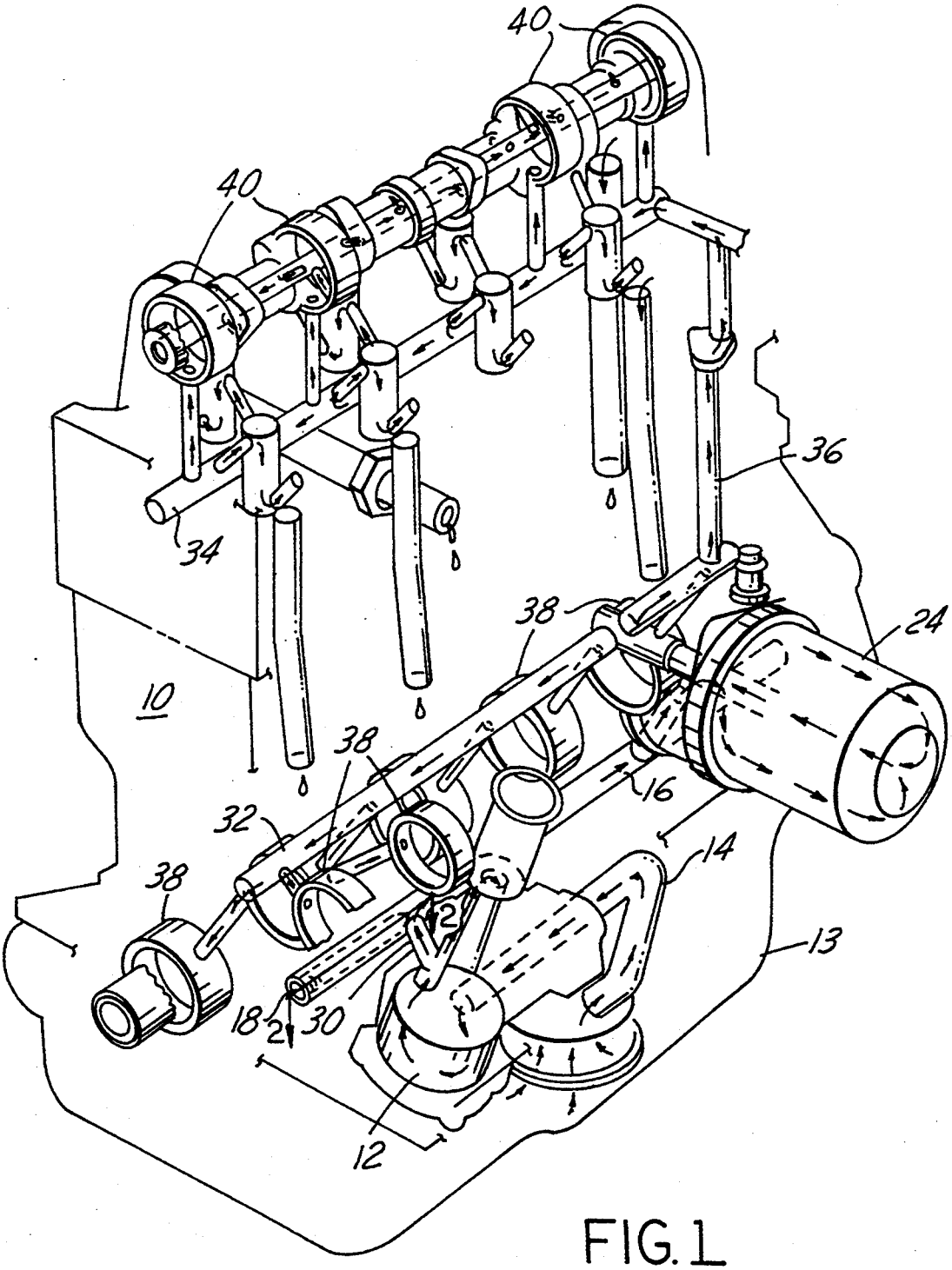
FIG. 1 is a schematic representation of an internal combustion engine having a lubrication system according to the present invention.

FIG. 1, as noted above, illustrates an internal combustion engine having a pressure lubrication system according to the present invention. Oil pump 12 provides lubricant to the engine by picking up oil from oil pan 13, by drawing the oil through oil pump inlet passage 14 into oil pump 12, and by pumping the oil to an elevated pressure. Oil flows from pump 12 through discharge port 30. After moving through the discharge port, oil passes into the main oil supply gallery 16, which extends between discharge port 30 and an oil receiving location, which in this case comprises engine oil filter 24. After leaving oil filter 24, oil passes through gallery 32. From gallery 32, oil proceeds to main bearing bores 38 and then, via passage 36, oil proceeds to gallery 34 at the top of the engine, where the oil is then available to lubricate camshaft bearings 40.

Automotive oil pumps are typically of the gear or gerotor types, both of which produce outputs characterized by pulsating pressure. Such a pressure output can cause noise if the pressure waves are reflected in a manner so as to reinforce the pressure pulses. Damper 18 according to the present invention will ameliorate such reinforcement of the pressure waves arising within the flowing oil, thereby preventing such acoustical waves from causing noise by excessive cyclic loading of the oil pump drive mechanism occasioned by backing up of pressure pulses through discharge port 30 into oil pump 12. Damper 18 could be employed not only in main oil supply gallery 16, but also in main bearing supply gallery 32, or also camshaft supply gallery 34. And, a damper according to the present invention could be applied at both ends of the gallery, if required in any particular engine.

Figure 2:
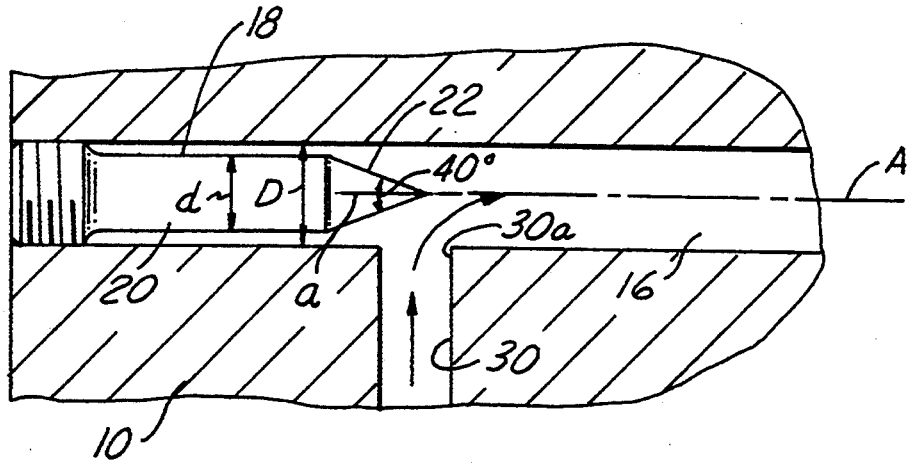
FIG. 2 is a portion of an engine shown in FIG. 1, taken along the line 2—2 of FIG. 1, and showing details of a damper according to the present invention.
Figure 3:
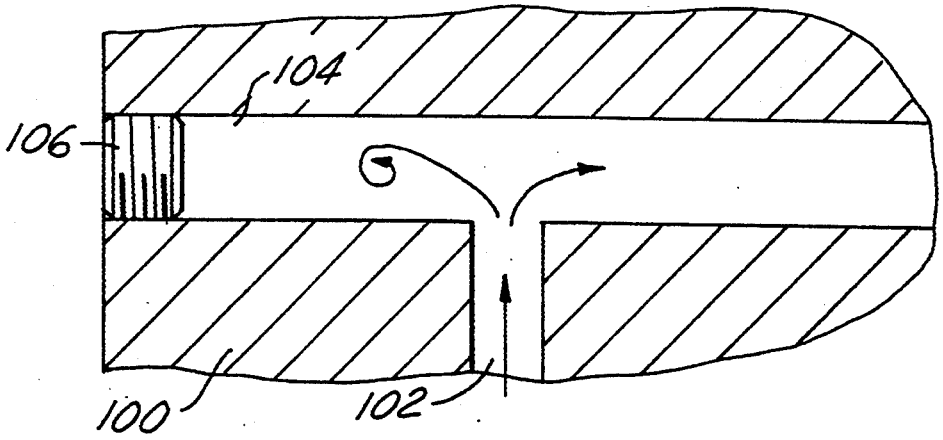
(PRIOR ART) FIG.3
FIG. 3 is a schematic representation of a portion of a prior art internal combustion engine lubrication system.

Details of the construction and positioning of a damper according to the present invention are shown in FIG. 2. Oil entering main supply gallery 16 via discharge port 30 is caused to flow around the corner formed by the intersection of gallery 16, discharge port 30, and damper 18. Conical surface 22, which projects into the bore of main oil supply gallery 16 at a point which is illustrated at being proximate the location at which oil is introduced into gallery 16 from discharge port 30, serves not only to assist in guiding the oil around the corner into gallery 16, but also performs part of the damping function. As noted above, it is believed that a damper according to the present invention may work by either breaking up reflected acoustic waves, or otherwise preventing their transmission back down into discharge port 30.

It has been determined that a damper according to the present invention will have an advantageous effect with its termination configured as the illustrated 40° conical surface with the central axis of the cone, the cylindrical body 20, a, and the central axis of bore or gallery 16, A, coincident. It is believed that this configuration functions at least in part by either preventing the reflection of pressure waves into discharge port 30, and in part by breaking up reflected waves before reinforcement occurs. It has further been determined that the ratio of the diameter of the cylindrical body 20*b, d*, to the diameter of gallery 16, D, should be about 75%. Those skilled in the art will appreciate in view of this disclosure, however, that other dimensional relationships including the angle of cone 22 and the relative diameters of cylindrical body 20 and gallery 16 may be altered according to the needs of an engine to which the present system is applied. Moreover, it has been determined that damper 18 may work with a blunt end if proper positioning can be determined accurately so as to prevent the reflection of pressure waves into discharge port 30.

Those skilled in the art will appreciate in view of this disclosure that various alternative designs and embodiments may be employed for practicing the present invention, as defined by the following claims.

I claim:

1. A lubrication system for an internal combustion engine, comprising:

an oil pump having an inlet passage and a discharge port;

a main oil supply gallery extending between said oil pump discharge port and at least one oil receiving location within the engine, with said gallery comprising a cylindrical bore; and a damper situated within said oil supply gallery for limiting the propagation of pressure pulses within the gallery, with said damper comprising a generally cylindrical body having a generally conical surface projecting into said cylindrical bore, with the central axis of the generally conical surface and the central axis of the cylindrical body coincident with the central axis of the cylindrical bore.

2. A lubrication system according to claim 1, wherein the outer diameter of said cylindrical body is slightly less than the diameter of said cylindrical bore.

3. A lubrication system according to claim 1, wherein said conical surface projects into said bore to a location which is proximate the location at which oil is introduced into the oil supply gallery from the oil pump discharge port.

4. A lubrication system for an internal combustion engine, comprising:

an oil pump having an inlet passage and a discharge port;

a plurality of generally cylindrical oil supply galleries extending between the discharge port of said oil pump and a plurality of bearings within the engine; and a damper situated within at least one of said oil supply galleries for limiting pressure pulses within the gallery, with said damper comprising a generally cylindrical body having a conical end projecting axially into said at least one gallery.

5. A lubrication system according to claim 4, wherein said damper projects into said at least one gallery at a point at which pressurized oil flows into said at least one gallery.

6. A lubrication system according to claim 4, wherein the included angle of said conical end is approximately 40°.

7. A lubrication system according to claim 4, wherein the outer diameter of said cylindrical body is approximately seventy-five percent of the diameter of said at least one gallery.

* * * * *